US011150059B2

(12) United States Patent
Hu et al.

(10) Patent No.: US 11,150,059 B2
(45) Date of Patent: Oct. 19, 2021

(54) DEEP SEA MINING METHOD

(71) Applicant: Central South University, Hunan (CN)

(72) Inventors: Qiong Hu, Hunan (CN); Liwen Deng, Hunan (CN); Xinpeng Yu, Hunan (CN); Jun Chen, Hunan (CN); Zhenfu Li, Hunan (CN)

(73) Assignee: Central South University, Changsha (CN)

( * ) Notice: Subject to any disclaimer, the term of this patent is extended or adjusted under 35 U.S.C. 154(b) by 0 days.

(21) Appl. No.: 17/145,336

(22) Filed: Jan. 9, 2021

(65) Prior Publication Data

US 2021/0231417 A1 Jul. 29, 2021

(30) Foreign Application Priority Data

Jan. 10, 2020 (CN) ..... 202010026448.6

(51) Int. Cl.

| | |
|---|---|
| ***E21C 50/00*** | (2006.01) |
| ***F42B 3/103*** | (2006.01) |
| ***F42D 3/04*** | (2006.01) |
| ***F42B 3/12*** | (2006.01) |

(52) U.S. Cl.

CPC ..... *F42B 3/103* (2013.01); *E21C 50/00* (2013.01); *F42B 3/12* (2013.01); *F42D 3/04* (2013.01)

(58) Field of Classification Search

CPC .... E21C 50/00; F42D 3/04; F42B 3/12; F42B 3/103

USPC ..... 299/14

See application file for complete search history.

(56) References Cited

U.S. PATENT DOCUMENTS 3,583,766 A * 6/1971 Padberg, Jr. ..... E21C 37/18 299/14

FOREIGN PATENT DOCUMENTS

| | | | |
|---|---|---|---|
| CN | 2702800 | Y | 6/2005 |
| CN | 101845616 | B | 6/2012 |
| CN | 105378214 | A | 3/2016 |
| CN | 205743909 | U | 11/2016 |
| CN | 107178369 | A | 9/2017 |
| CN | 107250480 | A | 10/2017 |
| CN | 107642346 | A | 1/2018 |
| JP | 2016021846 | A | 2/2016 |
| RU | 2520232 | C1 | 6/2014 |

OTHER PUBLICATIONS

Wang,Aiwu; Monitoring of Pick-up Effciency of Seabed Nodule Collector; Mining R & D,vol. 18,No. 3,Jun. 1998.

* cited by examiner

*Primary Examiner* — Sunil Singh

(57) ABSTRACT

A deep-sea mining device is sunk to a seabed mining area. A window of an exploding wire unit of a pulse exploding wire group is aligned to an exploding area. A strong pulse current is applied to an exploding wire of the exploding wire unit by an intense pulse power supply, and the exploding wire of the exploding wire unit and seawater in an exploding wires area are vaporized to generate shock waves, thereby breaking rocks through the impact of the seawater. The instantaneous high pressure causes the shock waves to crush the ore bed, and the pressure of the shock waves generated by the explosion of the exploding wire can be controlled by controlling the pulse voltage and current, so as to control the crushing head to crush rocks with different thicknesses.

9 Claims, 7 Drawing Sheets

DEEP SEA MINING METHOD

CROSS-REFERENCE TO RELATED APPLICATIONS

This application claims the benefit of priority from Chinese Patent Application No. 202010026448.6, filed on Jan. 10, 2020. The content of the aforementioned application, including any intervening amendments thereto, is incorporated herein by reference in its entirety.

TECHNICAL FIELD

The present application relates to mining, and more particularly to a method for deep-sea mining.

BACKGROUND

Generally, mechanical rollers are adopted as crushing heads of mining vehicles, and multiple sets of spikes are arranged on the mechanical rollers. Such crushing heads crush and peel ore bed from rock strata to achieve the crushing. However, the above mentioned method has some drawbacks. For example, when the thickness of the ore bed is not uniform, the spikes will crush the ore bed and the rock stratum in a fixed thickness corresponding to the length of the spikes. On the one hand, more rocks will be collected with ore raw materials of ore, resulting in a reduced delivery rate. On the other hand, the crushing heads are damaged in case of crushing a hard rock stratum. Moreover, in general, the ore mined by such method is unevenly crushed, and needs to be crushed again in the mining vehicles, so as to be easily transported in pipelines. In addition, when the mining vehicle operates in the ore bed which is not evenly distributed, it has low efficiency and bad mining effect, and cannot be adjusted in real time based on the geophysical data collected in the previous period. Especially, the thickness of the deep-sea cobalt-rich crust is 5-6 cm, about 2 cm on average or up to 10-15 cm, and such thin ore bed generally has an uneven thickness, so a good mining effect cannot be achieved using the traditional mechanical spike based mining method. The existing mining vehicles have bulky mechanical crushing heads, and additional crushing equipment and more complex collecting equipment are needed.

Electric water hammer is also known as an electrohydraulic effect. In recent years, the electric water hammer has also been gradually applied in exploration in the sea and ore crushing. In the electric water hammer, a pulse generator converts electric energy into a stress shock wave, and then to the seabed ore through the liquid medium, causing the splitting or crushing of the rocks in the deposit. The existing electric water hammer based deep-sea mining device and the method are mostly in the theoretical stage, and no systematic equipment and method has been provided.

SUMMARY

The present disclosure aims to provide a well-designed method for deep-sea mining.

Technical solutions of the present disclosure are described as follows in order to solve the above problems.

1. A method for deep-sea mining, comprising:

1) sinking a deep-sea mining device to a seabed mining area;

2) aligning a window of an exploding wire unit of a pulse exploding wire group with an exploding area;

3) applying a pulse current to an exploding wire of the exploding wire unit by a pulse power supply to instantly vaporize the exploding wire of the exploding wire unit and seawater in an exploding wire area to generate shock waves, thereby breaking rocks through the impact of the seawater; and 4) feeding a new exploding wire in the exploding wire unit for a next pulse; wherein the step 4 comprises:

4.1) letting an end of the exploding wire set in a coil cross an explosion space forward passing through a wire feeder; and 4.2) letting two electrodes provided on both sides of the explosion space be clamped to the exploding wire, respectively.

In some embodiments, the step 4.1 comprises:

4.11) driving a connecting tube, by a connecting cleaning mechanism that is opposite to the wire feeder, to extend backward from an initial position and cross the explosion space;

4.12) letting the end of the exploding wire be inserted into the connecting tube passing through the wire feeder; and 4.13) retracting the connecting tube forward to the initial position.

In some embodiments, the step 3 comprises:

3.1) connecting the two electrodes that are clamped to the exploding wire of the exploding wire unit to a conductivity detection unit for detecting whether the exploding wire is connected to the two electrodes; and 3.2) applying the pulse current to the exploding wire of the exploding wire unit by the pulse power supply.

In some embodiments, there are a plurality of pulse exploding wire groups which are spaced part in a circumference direction; and in the step 2, the plurality of pulse exploding wire groups rotate at a certain angle at the same time to allow the pulse exploding wire groups to sequentially align with the exploding area.

In some embodiments, wire feeders of circumferentially adjacent wire exploding units are arranged close to each other and driven by a same drive unit.

In some embodiments, connecting cleaning mechanisms of circumferentially adjacent wire exploding units are arranged close to each other and driven by a same drive unit.

In some embodiments, the wire feeder comprises:

an upper row of first grooved wheels;

a lower row of first grooved wheels; and a first drive unit;

wherein the upper row of first grooved wheels and the lower row of first grooved wheels are rotatably mounted at a crushing head; the exploding wire is clamped between grooves of the upper row of first grooved wheels and grooves of the lower row of first grooved wheels; the first drive unit drives the lower row of first grooved wheels to rotate to feed the exploding wire; and the exploding wire comprises a plurality of connected exploding wire sections; the exploding wire connecting section comprises a conductor connecting end, an exploding wire section and an insulating support layer; the conductor connecting end and the exploding wire section are integrally formed; the insulating support layer is coated on an outside of the exploding wire section; outer surfaces of the conductor connecting end are exposed between two adjacent insulation support layers; and the exploding wire section of the exploding wire connecting section and the conductor connecting end of an adjacent exploding wire connecting section are integrally formed. In this way, the first electrode and the second electrode can be easily clamped to the conductor connecting end of the connecting section and the conductor connecting end of the adjacent connecting section respectively, so that the exploding wire between the first electrode and the second electrode will be instantly vaporized (within 1-10 microseconds) under the action of the current of the intense pulse power supply.

In some embodiments, the connecting cleaning mechanism comprises:

the connecting tube;

an upper row of second grooved wheels;

a lower row of second grooved wheels;

a second drive unit; and a liquid inlet;

wherein the upper row of second grooved wheels and the lower row of second grooved wheels are rotatably mounted at a crushing head; the connecting tube is clamped between grooves of the upper row of second grooved wheels and grooves of the lower row of second grooved wheels; the second drive unit drives the lower row of second grooved wheels to rotate, so as to drive the connecting tube to linearly move; and the connecting tube is provided with a hole configured to allow the exploding wire to pass through; one end of the hole is opened outward; the liquid inlet is fixed on the connecting tube and is connected to the other end of the hole; and the liquid inlet is connected to a flusher.

The connecting cleaning mechanism has two main functions. Firstly, when the connecting tube moves from the first clamp mechanism to the second clamp mechanism, the conductor connecting end which is clamped in the first clamp mechanism 53 and cannot be not vaporized (because the diameter of the conductor connecting end 71 is much greater than the diameter of the exploding wire section) is ejected by the connecting cleaning mechanism 6. At the same time, residual materials adhering to walls of the first V-shaped groove and the second V-shaped groove can be scraped off. The high-pressure flusher discharges high-pressure liquid (such as seawater), and the high-pressure liquid flows into the hole through the liquid inlet 64 and then ejected at a high speed from one end of the hole. Therefore, the first clamp mechanism and the second clamp mechanism are better cleaned, so as to ensure that the first electrode and the second electrode can be electrically connected to the exploding wire stably and efficiently.

In addition, after one end of the connecting tube is pressed to the lower clamp part and the upper clamp part of the second clamp mechanism, the exploding wire moves from the lower clamp part and the upper clamp part of the second clamp mechanism to the lower clamp part and the upper clamp part of the first clamp mechanism through the hole of the connecting tube. Then, the connecting tube is withdrawn, so that the lower clamp part and the upper clamp part of the first clamp mechanism tightly clamp the exploding wire. This avoids the situation that the exploding wire fails to be accurately fed into the lower clamp part and upper clamp part of the first clamp mechanism when the exploding wire is accidentally bent, which ensures the reliability of the device.

In some embodiments, the upper row of first grooved wheels of the wire feeder are rotatably mounted on a first wheel plate which is fixed on a telescopic rod of a first hydraulic cylinder; a cylinder body of the first hydraulic cylinder is fixed on a mounting frame; the first drive unit comprises a first hydraulic motor, a first drive worm and a first drive worm wheel; an output shaft of the first hydraulic motor drives the first drive worm; the first drive worm is matched with the first drive worm wheel; and the first drive worm wheel is fixed on the lower row of first grooved wheels, so that the first hydraulic motor drives the lower row of grooved wheels to rotate. The first drive worm is matched with the first drive worm wheel to achieve speed reduction, so as to improve the precision of wire feeding.

In some embodiments, the upper row of second grooved wheels are rotatably mounted on a second wheel plate which is fixed on a telescopic rod of a second hydraulic cylinder; a cylinder body of the second hydraulic cylinder is fixed on a mounting frame; the second drive unit comprises a second hydraulic motor, a second drive worm and a second drive worm wheel; an output shaft of the second hydraulic motor drives the second drive worm; the second drive worm is matched with the second drive worm wheel; and the second drive worm wheel is fixed on the lower row of second grooved wheels, so that the second hydraulic motor drives the lower row of push tube grooved wheels to rotate. The second drive worm is matched with the second drive worm wheel to achieve the speed reduction, so as to improve the precision of tube pushing.

Compared to the prior art, the method of the present invention has the following beneficial effects.

Instantaneous high pressure causes a shock wave to crush the ore bed, where pressure of the shock wave generated by the explosion of exploding wires can be controlled by controlling the pulse voltage and current, so as to control the crushing head to crush rocks with different thicknesses. Mining ores with uneven distribution of ore beds in a complex deep-sea mining environment can be developed. In addition, for a mining environment where the ore bed has different hardness and compressive strength from the rock stratum, the shock wave is configured to crush the ore bed by pressure. The energy of the shock wave is appropriately controlled to crush the ore bed, which can achieve a better mining and crushing effect.

Compared to the traditional the mechanical spike based mining method, the method used herein has the advantages of low rock content in the collected ores, high collection efficiency and good crushing effect. According to the principle of rock fragmentation, when the pressure of the shock wave is stronger than the compressive strength of the ore bed, the ore bed is broken. Because of the uniformity of the shock wave, the pressure applied to all parts of the rock stratum is maintained in a uniform interval, so a good crushing effect can be achieved. Compared to the traditional mechanical spike based mining method, the method of the present disclosure can achieve an even mining effect.

Figure 1:
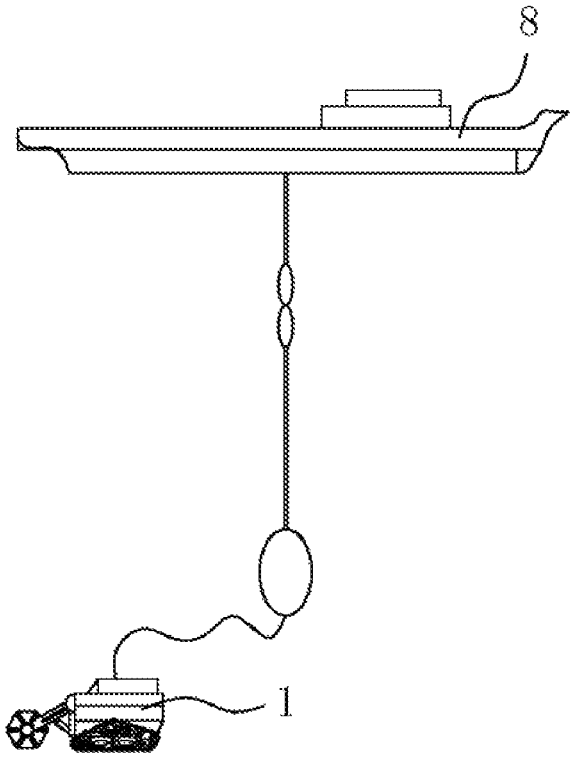
FIG. 1 is a schematic diagram of a mining vehicle in a working state according to an embodiment of the present disclosure.

In the drawings, 1, mining vehicle; support arm 11; 2, crushing head; 21, explosion space; 22, window; 31, drum for feeding exploding wires; 32, first guide grooved wheel; 33, second guide grooved wheel; 4, wire feeder; 41, upper row of first grooved wheels; 42, lower row of first grooved wheels; 43, first wheel plate; 44, first hydraulic cylinder; 45, first hydraulic motor; 46, first drive worm; 47, first drive worm wheel; 48, first one-way bearing; 49, first sleeve; 51, first electrode; 52, second electrode; 53, first clamp mechanism; 54, second clamp mechanism; 55, lower clamp part; 56, upper clamp part; 57, clamp hydraulic cylinder; 58, first V-shaped groove; 59, second V-shaped groove; 510, outer baffle; 511, inner baffle; 6, connecting cleaning mechanism; 61, connecting tube; 62, upper row of second grooved wheels; 63, lower row of second grooved wheels; 64, liquid inlet; 65, second wheel plate; 66, second hydraulic cylinder; 67, second hydraulic motor; 68, second drive worm; 69, second drive worm wheel; 610, second one-way bearing; 611, second sleeve; 7, exploding wire connecting section; 71, conductor connecting end; 72, exploding wire section; 73, insulating support layer; 8, mining ship.

DETAILED DESCRIPTION OF EMBODIMENTS

The present disclosure will be further described in detail with reference to the embodiments and the accompanying drawings. These embodiments are illustrative of the present disclosure, and are not intended to limit the scope of the present disclosure.

Figure 2:
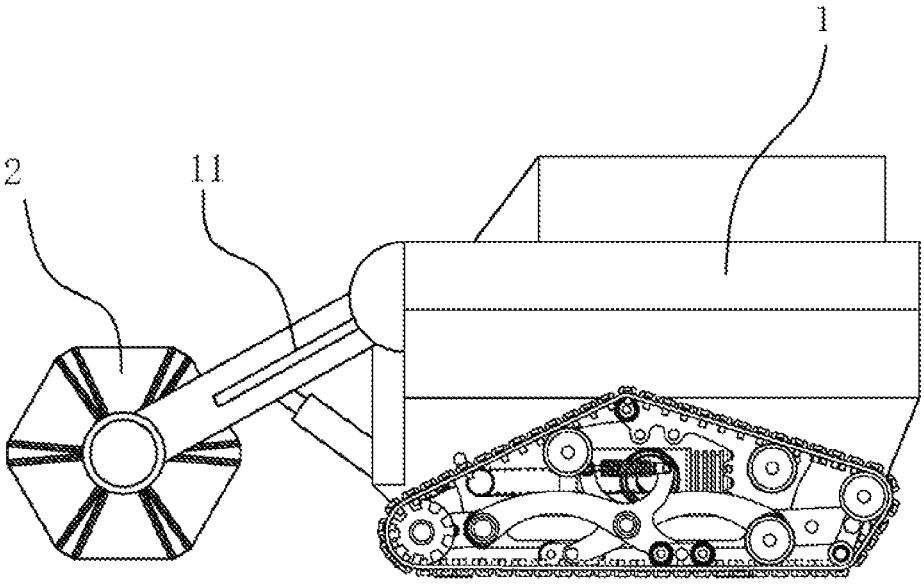
FIG. 2 is a schematic diagram of the mining vehicle according to an embodiment of the present disclosure.
Figure 3:
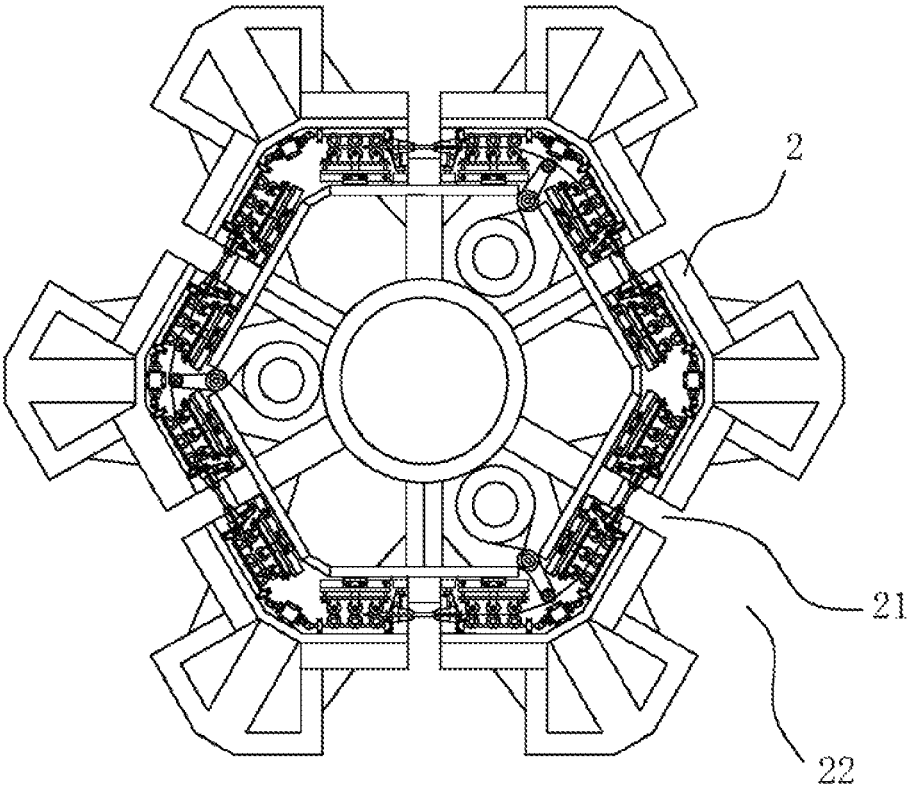
FIG. 3 is a schematic diagram of a crushing head according to an embodiment of the present disclosure.
Figure 4:
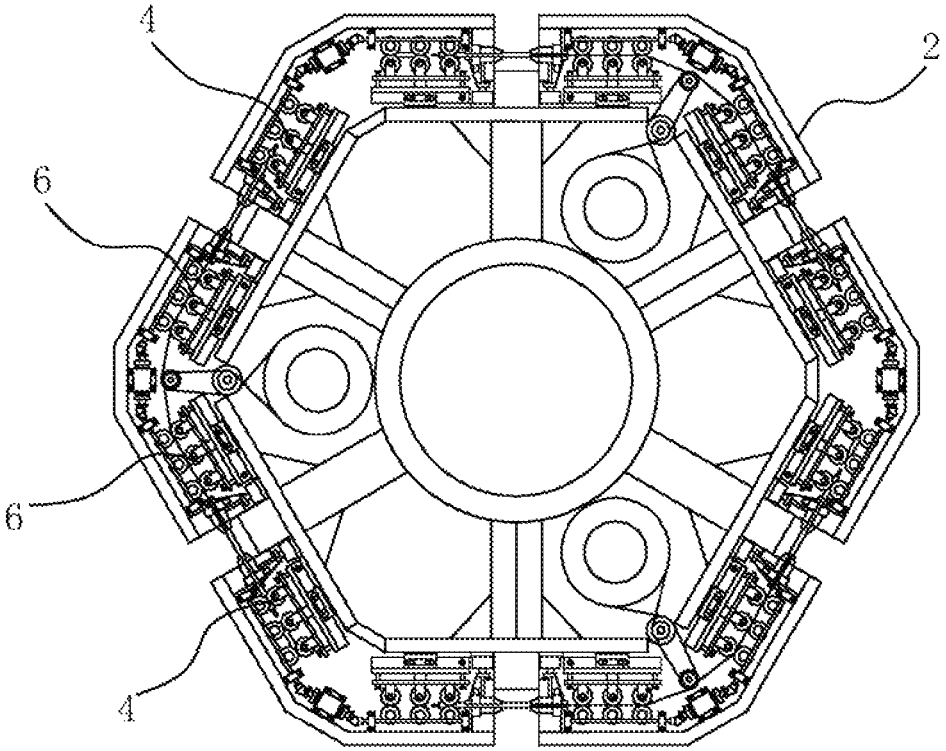
FIG. 4 is a schematic diagram of an internal structure of the crushing head according to an embodiment of the present disclosure.
Figure 5:
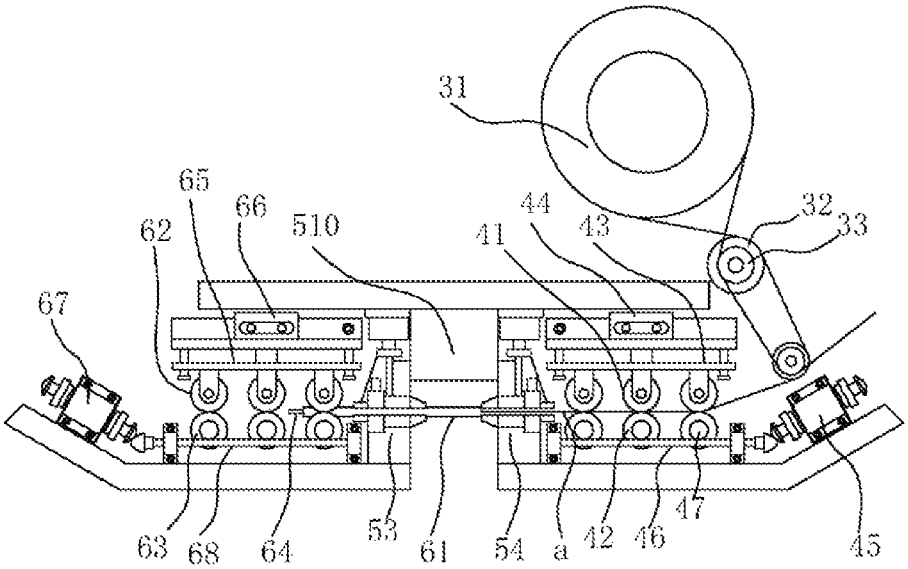
FIG. 5 is a schematic diagram of an exploding wire unit in a working state according to an embodiment of the present disclosure.
Figure 6:
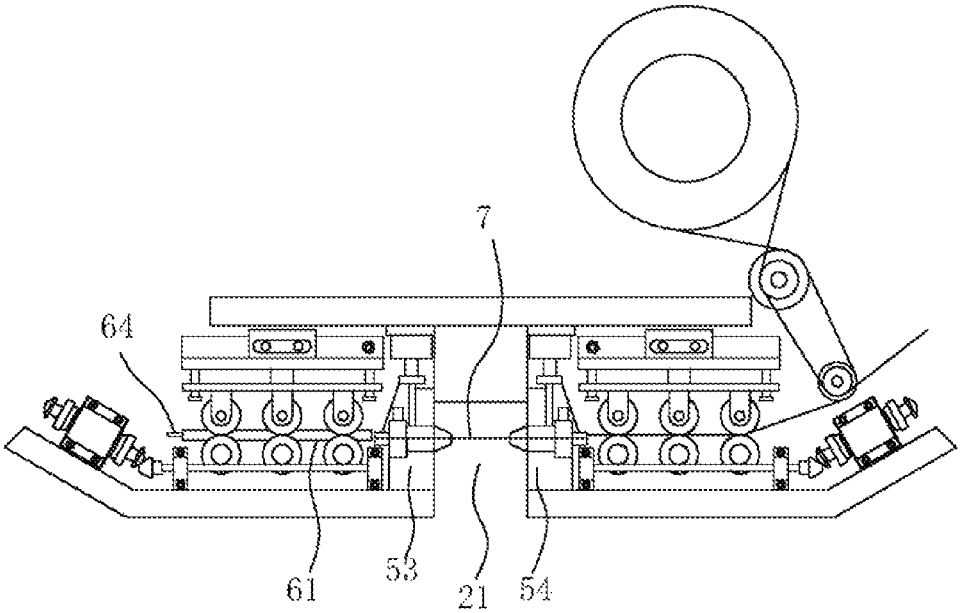
FIG. 6 is a schematic diagram of the exploding wire unit in another working state according to an embodiment of the present disclosure.
Figure 7:
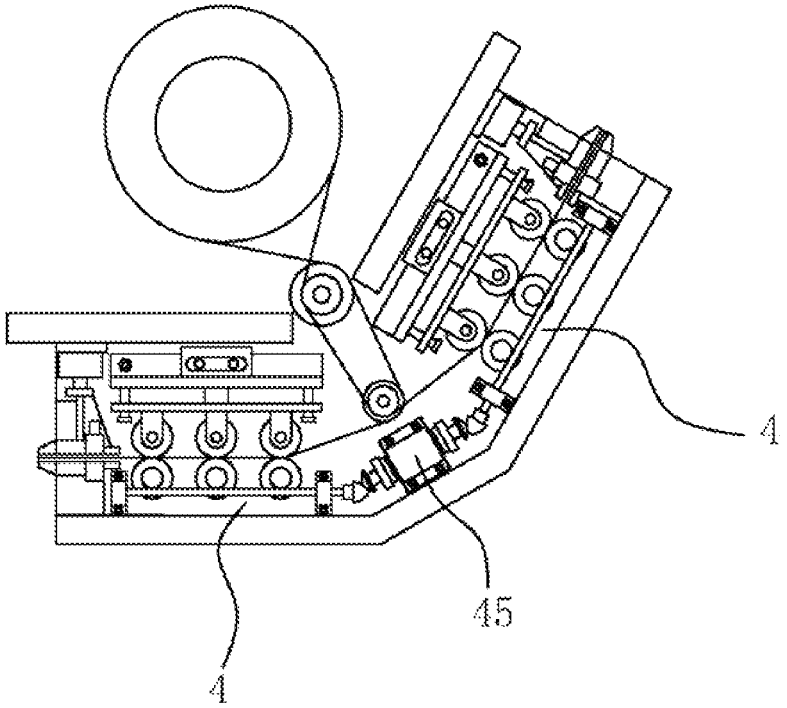
FIG. 7 shows wire feeders of two adjacent exploding wire units according to an embodiment of the present disclosure.
Figure 8:
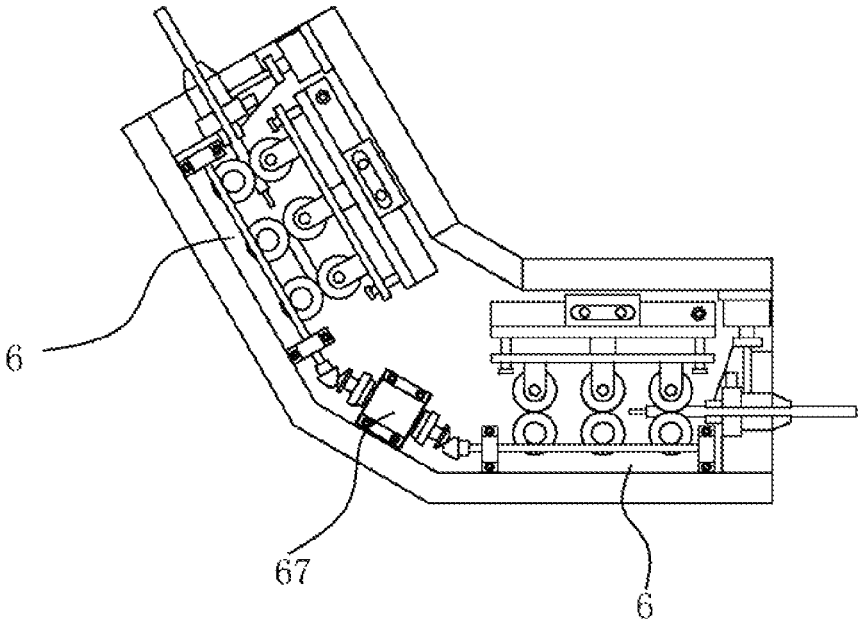
FIG. 8 shows tube pushing mechanisms of the two adjacent exploding wire units according to an embodiment of the present disclosure.
Figure 9:
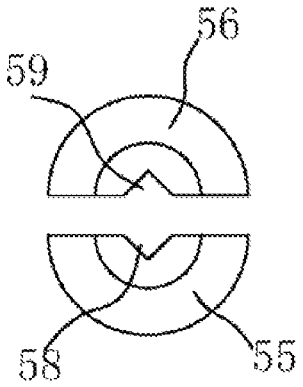
FIG. 9 is a schematic diagram of an upper clamp part and a lower clamp part according to an embodiment of the present disclosure.
Figure 10:
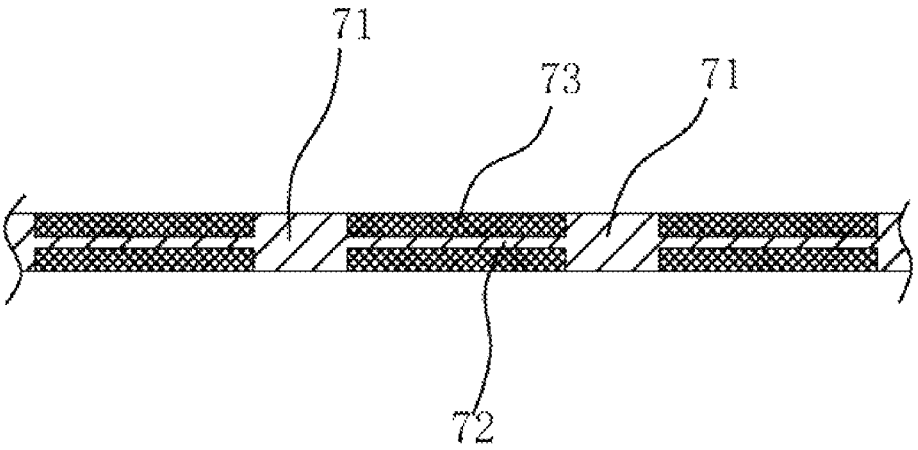
FIG. 10 is a schematic diagram of an exploding wire connecting section according to an embodiment of the present disclosure.
Figure 11:
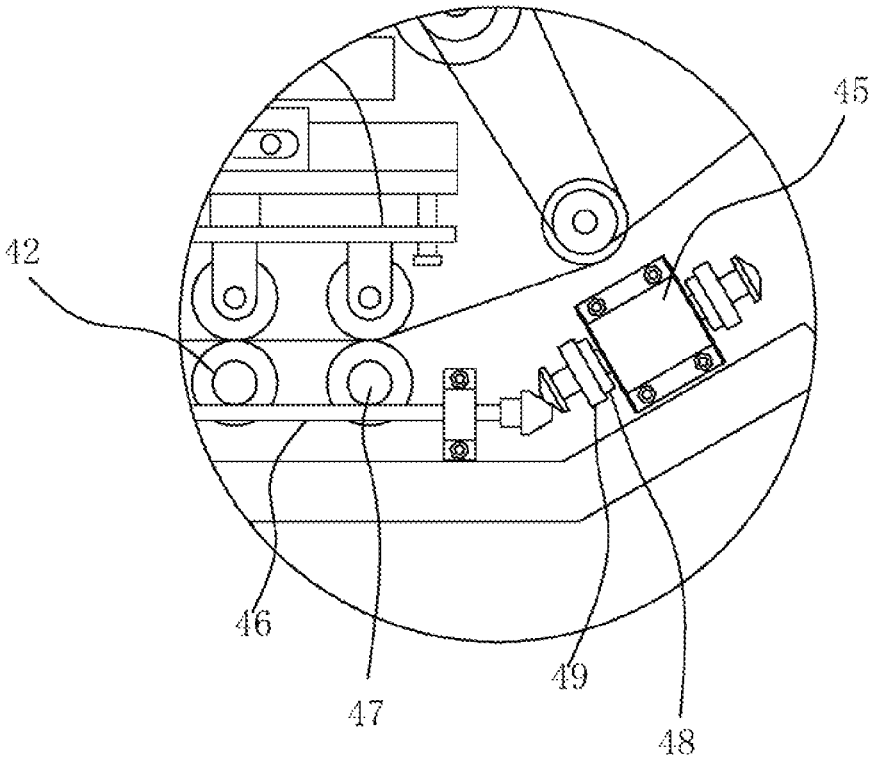
FIG. 11 is a schematic diagram of a first hydraulic motor according to an embodiment of the present disclosure.
Figure 12:
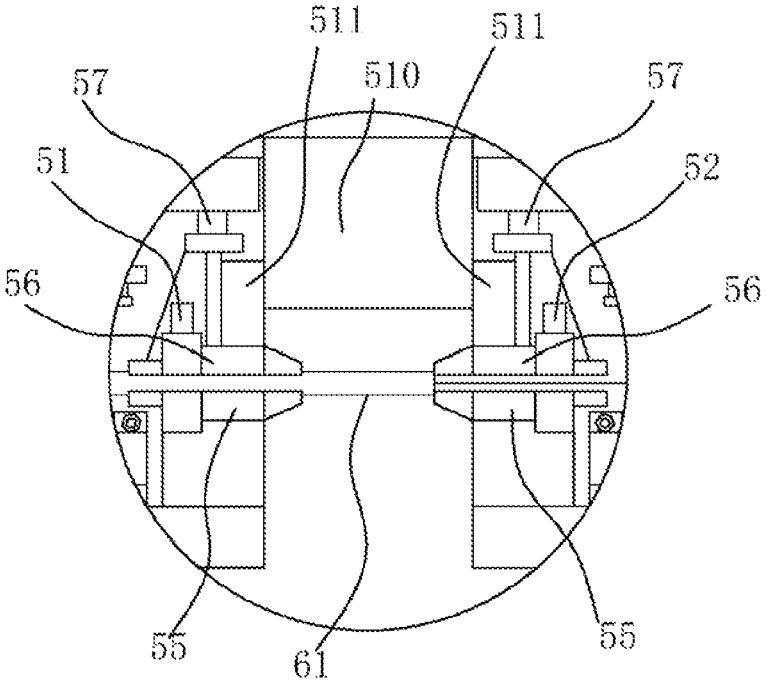
FIG. 12 is a schematic diagram of a first clamp mechanism and a second clamp mechanism according to an embodiment of the present disclosure.
Figure 13:
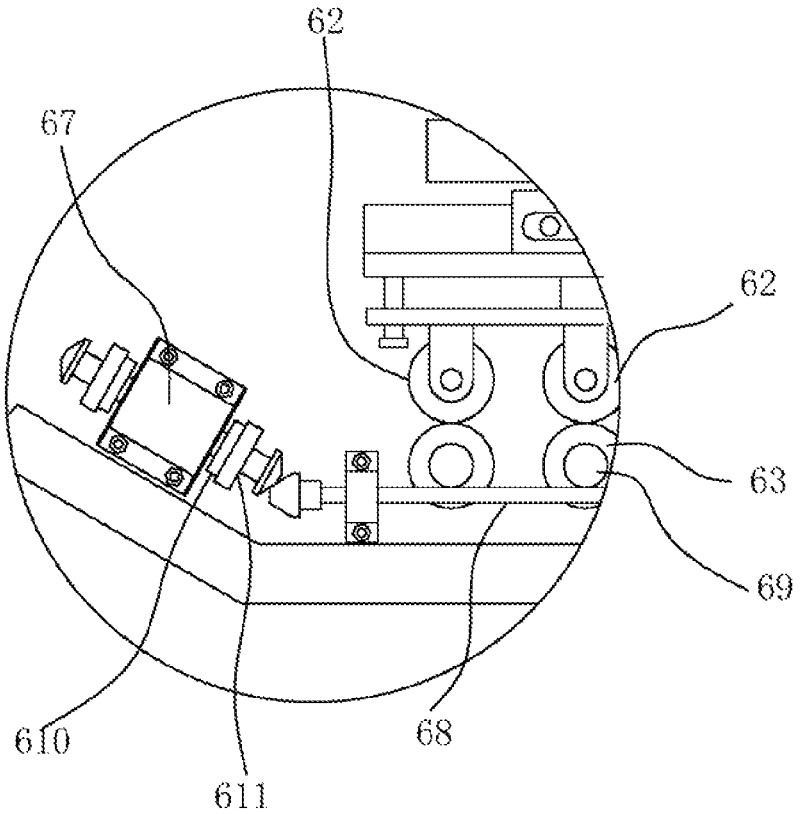
FIG. 13 is a schematic diagram of a second hydraulic motor according to an embodiment of the present disclosure.

Referring to FIGS. 1-13, this embodiment provides a deep-sea mining device, including a mining vehicle 1, a crushing head 2 and a pulse exploding wire group. The pulse exploding wire group includes a plurality of exploding wire units, and is fixed at the crushing head 2. The exploding wire unit includes a drum 31 for feeding wires, a wire feeder 4, a first electrode (high voltage electrode) 51, a second electrode (low voltage electrode) 52, a first clamp mechanism 53 and a second clamp mechanism 54. An exploding wire is wound on the drum 31 which is mounted at the crushing head 2. The first electrode 51 and the second electrode 52 are connected to two output interfaces of an intense pulse power supply, respectively.

The wire feeder 4 includes an upper row of first grooved wheels 41, a lower row of first grooved wheels 42 and a first drive unit. The upper row of first grooved wheels 41 and the lower row of first grooved wheels 42 are rotatably mounted at the crushing head 2. The exploding wire is clamped between grooves of the upper row of first grooved wheels 41 and the lower row of first grooved wheels 42. The first drive unit drives the lower row of first grooved wheels 42 to rotate for feeding the exploding wire.

The exploding wire includes a plurality of connected exploding wire sections 7. The exploding wire connecting section 7 includes a conductor connecting end 71, an exploding wire section 72 and an insulating support layer 73. The conductor connecting end 71 and the exploding wire section 72 are integrally formed. The insulating support layer 73 is coated on the exploding wire section 72. An outer surface of the conductor connecting end 71 is exposed between two adjacent insulation support layers 73. The exploding wire section 72 of an exploding wire connecting section 7 and the conductor connecting end 71 of an adjacent exploding wire connecting section 7 are integrally formed. In this way, the first electrode 51 and the second electrode 52 can easily clamp the conductor connecting end 71 of the exploding wire connecting section 7 and the conductor connecting end 71 of the adjacent exploding wire connecting section 7 respectively, so that the exploding wire between the first electrode and the second electrode will be instantly vaporized (within 1-10 microseconds) under the action of the current of the intense pulse power supply.

Each of the first clamp mechanism 53 and the second clamp mechanism 54 includes a lower clamp part 55, an upper clamp part 56 and a clamp hydraulic cylinder 57. The lower clamp part 55 and a cylinder body of the clamp hydraulic cylinder 57 are fixed at the crushing head 2, and a telescopic rod of the clamp hydraulic cylinder 57 is fixed on the upper clamp part 56. The lower clamp part 55 and the upper clamp part 56 are respectively provided with a first V-shaped groove 58 and a second V-shaped groove 59, and the clamp hydraulic cylinder 57 drives the lower clamp part 55 and the upper clamp part 56 to move downward to clamp the exploding wire. The first electrode 51 and the second electrode 52 are fixed at the upper clamp part 56 of the first clamp mechanism 53 and the upper clamp part 56 of the second clamp mechanism 54, respectively. An explosion space 21, in which the exploding wire is exploded and vaporized, is provided between the first clamp mechanism 53 and the second clamp mechanism 54. A window 22 is provided on an outside of the explosion space 21 to allow shock waves to act on a seabed.

In this embodiment, the exploding wire unit further includes a connecting cleaning mechanism 6 including a connecting tube 61, an upper row of second grooved wheels 62, a lower row of second grooved wheels 63, a second drive unit and a liquid inlet 64. The upper row of second grooved wheels 62 and the lower row of second grooved wheels 63 are rotatably mounted at the crushing head 2. The connecting tube 61 is clamped between grooves of upper row of second grooved wheels 62 and grooves of the lower row of second grooved wheels 63. The second drive unit drives the lower row of second grooved wheels 63 to rotate to drive the connecting tube 61 to linearly move. The connecting tube 61 is provided with a hole from which the exploding wire passes. One end of the hole is opened outward. The liquid inlet 64 is fixed at the connecting tube 61 and is connected to the other end of the hole. The liquid inlet 64 is connected to a high-pressure flusher.

The connecting cleaning mechanism 6 has two main functions. Firstly, when the connecting tube 61 moves from the first clamp mechanism 53 to the second clamp mechanism 54, the conductor connecting end 71 which is clamped in the first clamping mechanism 53 and cannot be not vaporized (because the diameter of the conductor connecting end 71 is much greater than the diameter of the exploding wire section) is ejected by the connecting cleaning mechanism 6. At the same time, residual materials adhering to walls of the first V-shaped groove 58 and the second V-shaped groove 59 can be scraped off. The high-pressure flusher discharges high-pressure liquid (such as seawater), and the high-pressure liquid flows into the hole through the liquid inlet 64 and then ejected at a high speed from one end of the hole. Therefore, the first clamp mechanism 53 and the second clamp mechanism 54 are better cleaned, so as to ensure that the first electrode 51 and the second electrode 52 can be electrically connected to the exploding wire stably and efficiently.

In addition, after one end of the connecting tube 61 is pressed to the lower clamp part 55 and the upper clamp part 56 of the second clamp mechanism 54, the exploding wire moves from the lower clamp part 55 and the upper clamp part 56 of the second clamp mechanism 54 to the lower clamp part 55 and the upper clamp part 56 of the first clamp mechanism 53 through the hole of the connecting tube 61. Then, the connecting tube 61 is retracted, so that the lower clamp part 55 and the upper clamp part 56 of the first clamp mechanism 53 tightly clamp the exploding wire. This avoids the situation that the exploding wire fails to be accurately fed between the lower clamp part 55 and upper clamp part 56 of the first clamp mechanism 53 when the exploding wire is accidentally bent, which ensures the reliability of the device.

In this embodiment, the upper row of first grooved wheels 41 of the wire feeder 4 is rotatably mounted on a first wheel plate 43 which is fixed on a telescopic rod of a first hydraulic cylinder 44. A cylinder body of the first hydraulic cylinder 44 is fixed on a mounting frame. The first drive unit includes a first hydraulic motor 45, a first drive worm 46 and a first drive worm wheel 47. An output shaft of the first hydraulic motor 45 drives the first drive worm 46. The first drive worm 46 is matched with the first drive worm wheel 47. The first drive worm wheel 47 is fixed on the lower row of first grooved wheels 42, so that the first hydraulic motor 45 drives the lower row of first grooved wheels 42 to rotate. The first drive worm 46 is matched with the first drive worm wheel 47 to achieve speed reduction, so as to improve the precision of wire feeding.

In this embodiment, the upper row of second grooved wheels 62 are rotatably mounted on a second wheel plate 65 which is fixed on a telescopic rod of a second hydraulic cylinder 66. A cylinder body of the second hydraulic cylinder 66 is fixed on the mounting frame. The second drive unit includes a second hydraulic motor 67, a second drive worm 68 and a second drive worm wheel 69. An output shaft of the second hydraulic motor 67 drives the second drive worm 68. The second drive worm 68 is matched with the second drive worm wheel 69. The second drive worm wheel 69 is fixed on the lower row of second grooved wheels 63, so that the second hydraulic motor 67 drives the lower row of second grooved wheels 63 to rotate. The second drive worm 68 is matched with the second drive worm wheel 69 to achieve the speed reduction, so as to improve the precision of tube pushing.

In this embodiment, the first hydraulic motor 45 uses a dual-axis hydraulic motor. Output shafts of two ends of the first hydraulic motor 45 are fixed on inner rings of two first one-way bearings 48, respectively, where the two first one-way bearings 48 have opposite one-way characteristics, i.e., when the dual-axis hydraulic motor rotates in a forward direction, only the outer ring of one of the two first one-way bearings 48 is driven to rotate, and the outer ring of the other one of the two first one-way bearings 48 cannot be driven to rotate; and correspondingly, when the dual-axis hydraulic motor reversely rotates, the outer ring of one of the two first one-way bearings 48 is not driven to rotate, and only the outer ring of the other of the two first one-way bearings 48 is driven to rotate. Two first sleeves 49 are respectively fixed on the out rings of the two first one-way bearings 48. The two first sleeves 49 are fixed on two first bevel gears. The two first bevel gears mesh with two second bevel gears, respectively. The two second bevel gears are fixed on the first drive worms 46 of two exploding wire units. The two-axis hydraulic motor used herein can drive two wire feeders to work, so that a compact space in the crushing head 2 is effectively used, thereby improving the compactness of the device.

In this embodiment, the second hydraulic motor 67 uses a dual-axis hydraulic motor. Output shafts of two ends of the second hydraulic motor 67 are fixed on inner rings of two second one-way bearings 610, respectively, where the two second one-way bearings 610 have opposite one-way characteristics, i.e., when the dual-axis hydraulic motor rotates in a forward direction, only the outer ring of one of the two second one-way bearings 610 is driven to rotate, and the outer ring of the other one of the two second one-way bearings 610 cannot be driven to rotate; and correspondingly, when the dual-axis hydraulic motor reversely rotates, the outer ring of one of the two second one-way bearings 610 is not driven to rotate, and only the outer ring of the other of the two second one-way bearings 610 is driven to rotate. Two second sleeves 611 are respectively fixed on the out rings of the two second one-way bearings 610. The two second sleeves 611 are fixed on two third bevel gears. The two third bevel gears mesh with two fourth bevel gears, respectively. The two fourth bevel gears are fixed on the second drive worms 68 of two exploding wire units. The two-axis hydraulic motor used herein can drive two wire feeders to work, so that a compact space in the crushing head 2 is effectively used, thereby improving the compactness of the device.

In this embodiment, the drums 31 of each two exploding wire units are coaxially and rotatably mounted on the crushing head 2. A first guide grooved wheel 32 and a second guide grooved wheel 33 are coaxially provided on the crushing head 2. The exploding wires introduced from the drum 31 are wound around the first guide grooved wheel 32 and the second guide grooved wheel 33, respectively, and then are guided to respective wire feeders 4. In this structure, the compact space in the crushing head 2 is effectively utilized and the compactness of the mechanism is improved.

In this embodiment, an outer baffle 510 is respectively provided at left and right sides of the explosion space. The first clamp mechanism 53 and the second clamp mechanism 54 both include an inner baffle 511 which is fixed on the upper clamp part 56. An outer side of the inner baffle 511 is tightly attached to an inner side of the outer baffle 510. In this structure, a gap between the outer baffle 510 and the inner baffle 511 is small after the upper clamp part 56 and the lower clamp part 55 are clamped, so the shock wave has less damage on the internal structure, thereby improving the durability of the equipment.

In this embodiment, the crushing head 2 is rotatably mounted on a support arm 11 of the mining vehicle 1. The support arm 11 of the mining vehicle 1 is provided with a hydraulic drive device for driving the crushing head 2 to rotate. A plurality of pulse exploding wire groups are uniformly and circumferentially distributed around the rotating axis of the crushing head 2. The exploding wire units of the same pulse exploding wire group are spaced apart along the rotating axis of the crushing head 2.

In this embodiment, a pulse generator adopts the intense pulsed power supply. Two pulse generators are provided in the mining vehicle 1 and are charged and work alternately, so as to avoid time delay in the energy storage process. The mining vehicle 1 is connected to a mining ship on the sea through a cable.

Specifically, in this embodiment, there are six pulse exploding wire groups, where each pulse exploding wire group includes 5-20 exploding wire units. After one exploding wire group suffers a pulse, the crushing head 2 will rotate one-sixth of a circle to allow the next exploding wire group to directly face the ore bed. The previous exploding wire group will enter the process of feeding the exploding wires. The hydraulic motor rotates to feed exploding wires between the two electrodes. After the feeding, a low-voltage current is applied to detect whether the exploding wire is well loaded on both sides. The two electrodes on both sides are connected with each other through round holes. The two electrodes are made of platinum, titanium alloys or stainless steel materials. After the pulse, the exploding wire between the two electrodes is instantly vaporized within 1-10 microseconds, and then a new exploding wire needs to be fed for next pulse.

The exploding wire between the two electrodes is instantly vaporized within 1-10 microseconds to generate an instantaneous high pressure. The instantaneous high pressure causes the shock wave to crush the ore bed, where the pressure of the shock wave generated by the explosion of the exploding wire can be controlled by controlling the pulse voltage and current, so as to control the crushing head 2 to crush rocks with different thicknesses. Thus, mining ores with uneven distribution of ore beds in a complex deep-sea mining environment can be developed. In addition, for a mining environment where the ore bed has different hardness and compressive strength from the rock stratum, the shock wave is configured to crush the ore bed by pressure. The energy of the shock wave is appropriately controlled to crush the ore bed, which can achieve a better mining and crushing effect. Compared with the traditional the mechanical spike based mining method, the method used herein has the advantages of low rock content in the collected ores, high collection efficiency and good crushing effect. According to the principle of rock fragmentation, when the pressure of the shock wave is stronger than the compressive strength of the ore bed, the ore bed is broken. Because of the uniformity of the shock wave, the pressure applied to all parts of the rock stratum is maintained in a uniform interval, so a good crushing effect can be achieved. It is concluded that compared to the traditional mechanical spike based mining method, the method of the present disclosure can achieve an even mining effect.

The specific mining steps of the deep-sea mining device are described as follows.

1) A deep-sea mining device is sunk to a seabed mining area.

2) The crushing head 2 is rotated at a certain angel to allow the window 22 of the exploding wire unit of the pulse exploding wire group to be aligned to an exploding area.

3) An intense pulse current is applied to the exploding wires of the exploding wire unit by the intense pulsed power supply. The exploding wires of the exploding wire unit and seawater in an exploding wire area are instantly vaporized to generate the shock waves, thereby crushing rocks through the impact of the seawater.

4) A new exploding wire is fed in the exploding wire unit for a next pulse.

The step 4 includes the following steps.

4.1) An end of the exploding wire set in a roll crosses the explosion space 21 passing through the wire feeder 4.

4.2) The two electrodes provided on both sides of the explosion space 21 are clamped to the exploding wire, respectively.

Specifically, the step 4.1 includes the following steps.

4.11) The connecting tube 61 is driven, by the connecting cleaning mechanism 6 that is opposite to the wire feeder 4, to extend backward from an initial position and cross the explosion space 21.

4.12) The end of the exploding wire is inserted into the connecting tube 61 passing through the wire feeder 4.

4.13) The connecting tube 61 retracts forward to the initial position.

Specifically, the step 3 includes the following steps.

3.1) The two electrodes clamped to the exploding wire of the exploding wire unit are connected to a conductivity detection unit for detecting whether the exploding wire is connected to the two electrodes.

3.2) The strong pulse current is applied to the exploding wire of the exploding wire unit by the intense pulse power supply.

Above-mentioned embodiments are only illustrative of the present disclosure. Any modification, additions or replacement made by those skilled in the prior art without departing from the content of the present disclosure and the scope defined by the appended claims shall fall within the scope of the present disclosure.

What is claimed is:

1. A method for deep-sea mining, comprising:

1) sinking a deep-sea mining device to a seabed mining area;

2) aligning a window of an exploding wire unit of a pulse exploding wire group with an exploding area;

3) applying a pulse current to an exploding wire of the exploding wire unit by a pulse power supply to instantly vaporize the exploding wire of the exploding wire unit and seawater in an exploding wire area to generate shock waves, thereby breaking rocks through the impact of the seawater; and 4) feeding a new exploding wire in the exploding wire unit for a next pulse;

wherein the step 4 comprises:

4.1) letting an end of the exploding wire set in a coil cross an explosion space forward passing through a wire feeder; and 4.2) letting two electrodes provided on both sides of the explosion space be clamped to the exploding wire, respectively;

wherein the step 4.1 comprises:

4.11) driving a connecting tube, by a connecting cleaning mechanism that is opposite to the wire feeder, to extend backward from an initial position and cross the explosion space;

4.12) letting the end of the exploding wire be inserted into the connecting tube passing through the wire feeder; and 4.13) retracting the connecting tube forward to the initial position.

2. The method of claim 1, wherein the step 3 comprises:

3.1) connecting the two electrodes that are clamped to the exploding wire of the exploding wire unit to a conductivity detection unit for detecting whether the exploding wire is connected to the two electrodes; and 3.2) applying the pulse current to the exploding wire of the exploding wire unit by the pulse power supply.

3. The method of claim 1, wherein connecting cleaning mechanisms of circumferentially adjacent wire exploding units are arranged close to each other and driven by a same drive unit.

4. The method of claim 1, wherein the wire feeder comprises:

an upper row of first grooved wheels;

a lower row of first grooved wheels; and a first drive unit;

wherein the upper row of first grooved wheels and the lower row of first grooved wheels are rotatably mounted at a crushing head; the exploding wire is clamped between grooves of the upper row of first grooved wheels and grooves of the lower row of first grooved wheels; the first drive unit drives the lower row of first grooved wheels to rotate to feed the exploding wire; and the exploding wire comprises a plurality of connected exploding wire sections; the exploding wire connecting section comprises a conductor connecting end, an exploding wire section and an insulating support layer; the conductor connecting end and the exploding wire section are integrally formed; the insulating support layer is coated on an outside of the exploding wire section; outer surfaces of the conductor connecting end are exposed between two adjacent insulation support layers; and the exploding wire section of the exploding wire connecting section and the conductor connecting end of an adjacent exploding wire connecting section are integrally formed.

5. The method of claim 4, wherein the upper row of first grooved wheels of the wire feeder are rotatably mounted on a first wheel plate which is fixed on a telescopic rod of a first hydraulic cylinder; a cylinder body of the first hydraulic cylinder is fixed on a mounting frame; the first drive unit comprises a first hydraulic motor, a first drive worm and a first drive worm wheel; an output shaft of the first hydraulic motor drives the first drive worm; the first drive worm is matched with the first drive worm wheel; and the first drive worm wheel is fixed on the lower row of first grooved wheels.

6. The method of claim 1, wherein the connecting cleaning mechanism comprises:

the connecting tube;

an upper row of second grooved wheels;

a lower row of second grooved wheels;

a second drive unit; and a liquid inlet;

wherein the upper row of second grooved wheels and the lower row of second grooved wheels are rotatably mounted at a crushing head; the connecting tube is clamped between grooves of the upper row of second grooved wheels and grooves of the lower row of second grooved wheels; the second drive unit drives the lower row of second grooved wheels to rotate, so as to drive the connecting tube to linearly move; and the connecting tube is provided with a hole configured to allow the exploding wire to pass through; one end of the hole is opened outward; the liquid inlet is fixed on the connecting tube and is connected to the other end of the hole; and the liquid inlet is connected to a flusher.

7. The method of claim 6, wherein the upper row of second grooved wheels are rotatably mounted on a second wheel plate which is fixed on a telescopic rod of a second hydraulic cylinder; a cylinder body of the second hydraulic cylinder is fixed on a mounting frame; the second drive unit comprises a second hydraulic motor, a second drive worm and a second drive worm wheel; an output shaft of the second hydraulic motor drives the second drive worm; the second drive worm is matched with the second drive worm wheel; and the second drive worm wheel is fixed on the lower row of second grooved wheels.

8. A method for deep-sea mining, comprising:

1) sinking a deep-sea mining device to a seabed mining area;

2) aligning a window of an exploding wire unit of a pulse exploding wire group with an exploding area;

3) applying a pulse current to an exploding wire of the exploding wire unit by a pulse power supply to instantly vaporize the exploding wire of the exploding wire unit and seawater in an exploding wire area to generate shock waves, thereby breaking rocks through the impact of the seawater; and 4) feeding a new exploding wire in the exploding wire unit for a next pulse;

wherein the step 4 comprises:

4.1) letting an end of the exploding wire set in a coil cross an explosion space forward passing through a wire feeder; and 4.2) letting two electrodes provided on both sides of the explosion space be clamped to the exploding wire, respectively;

wherein there are a plurality of pulse exploding wire groups which are spaced part in a circumference direction; and in the step 2, the plurality of pulse exploding wire groups rotate at a certain angle at the same time to allow the pulse exploding wire groups to sequentially align with the exploding area.

9. A method for deep-sea mining, comprising:

1) sinking a deep-sea mining device to a seabed mining area;

2) aligning a window of an exploding wire unit of a pulse exploding wire group with an exploding area;

3) applying a pulse current to an exploding wire of the exploding wire unit by a pulse power supply to instantly vaporize the exploding wire of the exploding wire unit and seawater in an exploding wire area to generate shock waves, thereby breaking rocks through the impact of the seawater; and 4) feeding a new exploding wire in the exploding wire unit for a next pulse;

wherein the step 4 comprises:

4.1) letting an end of the exploding wire set in a coil cross an explosion space forward passing through a wire feeder; and 4.2) letting two electrodes provided on both sides of the explosion space be clamped to the exploding wire, respectively;

wherein wire feeders of circumferentially adjacent wire exploding units are arranged close to each other and driven by a same drive unit.

* * * * *